US005114747A

United States Patent [19]

Fulton et al.

[11] Patent Number: 5,114,747

[45] Date of Patent: May 19, 1992

[54] TREATMENT OF HOT MELT INK IMAGES

[75] Inventors: Steven J. Fulton, Hanover; Gerald T. Peters, Jr., Canaan, both of N.H.; Charles W. Spehrley, Jr., Hartford, Vt.; Lawrence R. Young, West Lebanon, N.H.

[73] Assignee: Spectra, Inc., Hanover, N.H.

[21] Appl. No.: 651,302

[22] Filed: Feb. 6, 1991

Related U.S. Application Data

[60] Division of Ser. No. 416,158, Oct. 2, 1989, abandoned, which is a continuation-in-part of Ser. No. 230,797, Aug. 10, 1988, Pat. No. 4,873,134.

[51] Int. Cl.[5] ..... B05D 3/00; B05D 3/02; B05D 5/06

[52] U.S. Cl. ..... 427/164; 427/256; 427/271; 427/374.5; 427/398.2

[58] Field of Search ..... 346/1.1, 25; 427/164, 427/256, 288, 374.5, 398.2, 271

[56] References Cited

U.S. PATENT DOCUMENTS 4,751,528 6/1988 Spehrley, Jr. et al. ..... 346/140 R
4,801,473 1/1989 Creagh et al. ..... 427/164
4,853,706 8/1989 Van Bromer ..... 346/1.1
4,889,761 12/1989 Titterington et al. ..... 428/195
4,928,112 5/1990 Hock et al. ..... 346/25

*Primary Examiner*—Evan Lawrence
*Attorney, Agent, or Firm*—Brumbaugh, Graves, Donohue & Raymond

[57] ABSTRACT

In the embodiment described in the specification, a hot melt ink coating such as an image on a substrate is treated in a continuous manner by moving it along a platen having a heating zone to melt drops of hot melt ink and cause them to spread on the substrate. The platen has a flat central portion and curved portions at each end with curvatures sufficient to prevent formation of cockle. At the output end of the heating zone, the substrate is moved continuously into a quenching zone where a cooling platent cools the substrate by thermal contact at a rapid rate of at least 50° C. per second to prevent crystallization or frosting of the hot melt ink image thereby minimizing light transmission losses. After the quenching zone, the substrate is moved along a surface having a reverse curvature with respect to the curved portions of the heating platen to eliminate residual curvature of the substrate resulting from the curved portions of the heating platen.

6 Claims, 2 Drawing Sheets

TREATMENT OF HOT MELT INK IMAGES

REFERENCE TO RELATED APPLICATIONS

This application is a division of the copending Fulton et al. application Ser. No. 07/416,158, filed Oct. 2, 1989, abandoned, which is a continuation-in-part of the copending Fulton et al. application Ser. No. 07/230,797, filed Aug. 10, 1988, now U.S. Pat. No. 4,873,134.

BACKGROUND OF THE INVENTION

This invention relates to treatment of hot melt ink coatings such as images and, more particularly, to a system for treating hot melt ink images so as to enhance the quality of the images and, at the same time, prevent cockling and inhibit curling of the substrate which may occur in the processing of the hot melt ink images.

In the preparation of hot melt ink images, improved quality can be obtained by maintaining the temperature of the ink on a substrate above its melting point for a selected time. For example, as described in U.S. Pat. No. 4,873,134 to Fulton et al. which is incorporated herein by reference heating of a hot melt ink transparency prepared by ink jet printing to a temperature above the melting point of the hot melt ink followed by rapid quenching produces improved transparency projection characteristics. For optimum image quality, the time during which the ink is maintained above its melting point, and the rate of quenching thereafter, should be uniform throughout the image. Moreover, during this process the transparency substrate, which may be made of a sheet of polyester material such as Mylar, for example, may be heated to a temperature that is above the glass transition temperature of the substrate material.

Similarly, as described in U.S. Pat. No. 4,971,408 to Hoisington et al. the quality of hot melt ink images on porous substrates may be improved by maintaining the substrate at a temperature above its melting point for a selected time.

As described in the Spehrley Jr. et al. U.S. Pat. No. 4,751,528, however, when a substrate material passes between a high-temperature region and a low-temperature region, differential thermal expansion of the substrate tends to produce cockle in the substrate. Because of the rapid and extreme temperature changes to which a substrate may be subjected during processing of the type described in the above-mentioned Fulton et al. and Hoisington et al. patents, there is a strong tendency for the substrate to cockle. Such cockling causes separation of portions of the substrate from the heating and/or cooling surface, causing nonuniform heating and/or cooling of the ink drops on the substrate with an accompanying loss of quality of the image. To prevent such cockle, the substrate may be supported on a curved platen.

The response to heating of substrate materials such as transparency substrate polyesters and paper substrates differs and the cockle effect is caused in those substrates in differing ways. When a web or sheet of paper substrate passes from ambient temperature into a heated zone, it expands so that the width of the web increases but, after the paper has been heated for a period of time (typically 5 to 10 seconds), it loses moisture and shrinks, making the web or sheet narrower. On the other hand, the width of a polyester substrate remains larger after it passes into a heated zone so that the cockling effect resulting from such passage must be counteracted or prevented in a different way. During rapid processing of the type described herein, however, the moisture loss from a paper substrate is not significant so that, in general, the same procedures can be used to prevent cockle in both types of substrates during the processing described herein.

When a polyester substrate is kept at a temperature above its glass transition temperature, the substrate loses its flatness memory and tends to conform to the shape in which it is maintained when heated Thus, where a curved platen surface is provided to prevent cockle, hot melt ink transparencies which have been heated while on the curved surface are formed with a curl which prevents them from lying flat on a projection surface, causing the projected image to be unsatisfactory. Paper substrates may also be curled by such processing.

SUMMARY OF THE INVENTION

Accordingly, it is an object of the present invention to provide a new and improved system for treating hot melt ink coatings such as images which overcomes the above-mentioned disadvantages of the prior art.

A further object of the invention is to provide a system for treating hot melt ink transparencies to provide improved projection quality of color images.

An additional object is to provide a continuous process and apparatus for treating hot melt ink images in which the images are heated rapidly and uniformly for a predetermined time period and cooled rapidly at the end of the predetermined period.

Another object of the invention is to provide a system for reducing curl in hot melt ink transparencies to a level which does not cause deterioration of a projected image These and other objects of the invention are attained by moving a hot melt ink coating such as an image on a substrate in a controlled manner into a heating zone across a surface which has sufficient curvature to prevent cockle, maintaining the image within the heating zone for a time long enough to permit hot melt ink drops to melt and spread on the substrate, and moving the image in a controlled manner out of the heating zone along a surface which has sufficient curvature to prevent formation of cockle in the substrate. Preferably, the substrate is supported at a reduced curvature or held substantially flat in the region of the heating zone between the curved surfaces, and for this purpose, it may be held against the surface of a heated platen.

To avoid crystallization or frosting during cooling of the hot melt ink in the image formed on the substrate, the image is moved from the heating zone to a quenching zone where the temperature is reduced at a rapid rate, such as at least 50° C./sec. and, preferably, at least 500° C./sec. Preferably, quenching is effected by moving the substrate into heat-transfer contact with a relatively cold platen. In addition, to reduce or eliminate curl which may interfere with the quality of projected transparency images, the substrate is preferably moved along a surface having a reverse curvature after quenching. To assure uniform treatment of the hot melt ink image, the substrate is moved continuously through the heating and quenching zones at a uniform rate.

One form of apparatus for treating hot melt ink images includes a heated platen having a substantially flat center surface and curved surfaces at the inlet and outlet ends, along with a substrate-conveying mechanism for conveying an image-containing substrate across the platen surface at a uniform rate and holding it against the curved and flat portions of the surface as it is moved across the surface. To provide quenching, a cooling platen has a quenching zone positioned adjacent to the outlet end of the heated platen and, to assure good heat transfer, the surface of the cooling platen in the quenching zone is preferably curved. In addition, to remove curl in the substrate, the cooling platen has a reversely curved surface to receive the substrate after it has passed through the quenching zone.

BRIEF DESCRIPTION OF THE DRAWINGS

Further objects and advantages of the invention will be apparent from a reading of the following description in conjunction with the accompanying drawings in which.

DESCRIPTION OF PREFERRED EMBODIMENT

Figure 1:
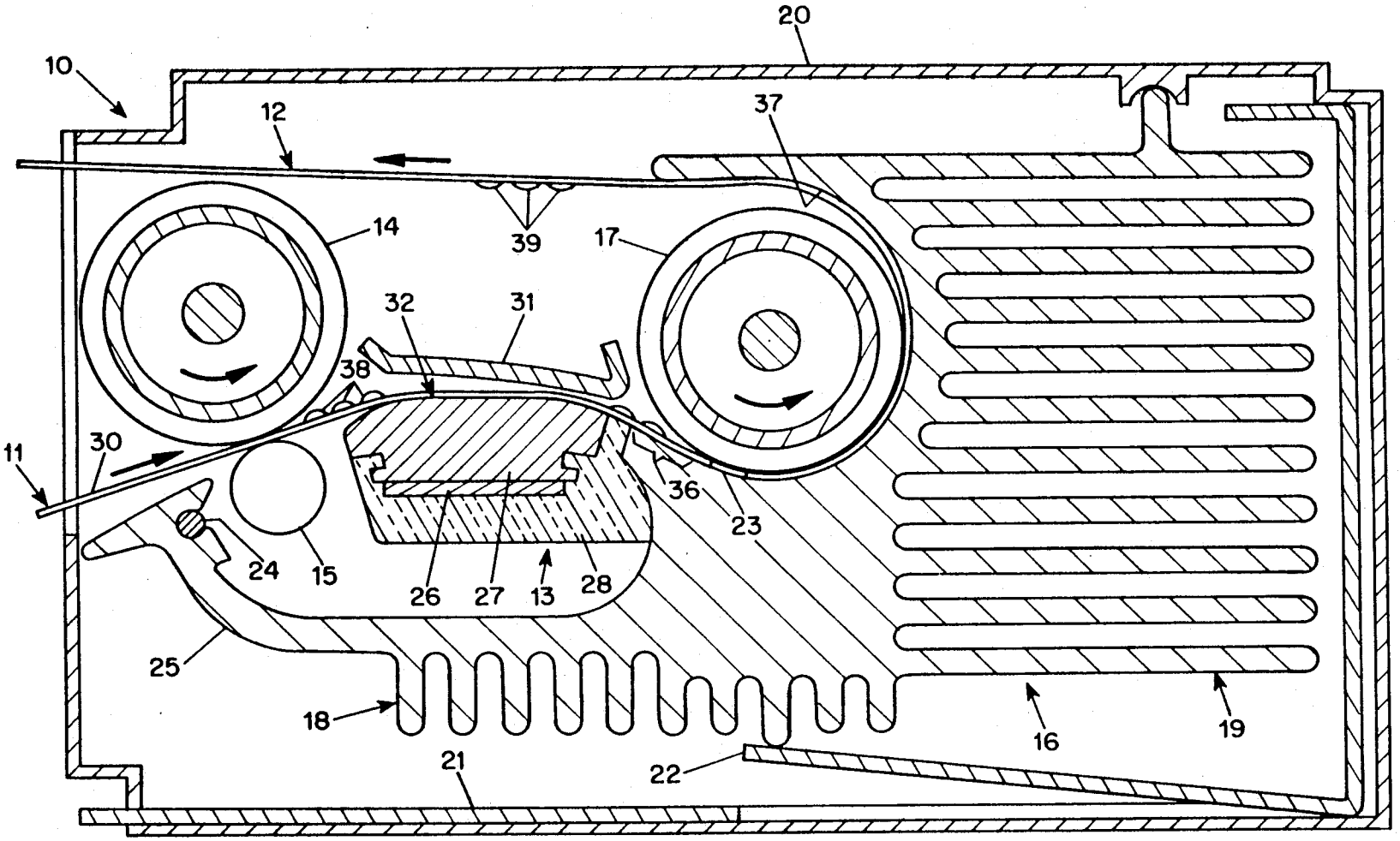
FIG. 1 is a schematic sectional view illustrating a representative arrangement for treating hot melt ink images in accordance with the invention.

The typical embodiment of the invention shown in the drawings comprises an apparatus 10 having a heating zone for heating a hot melt ink print 11 to melt the ink for a selected time period and a quenching zone for quenching the hot melt ink image at the end of the selected time period to produce a print 12 in which the hot melt ink has spread so as to provide improved image quality without objectionable curl. The heating zone is formed by a substrate heating platen 13, described in greater detail hereinafter, to which the print 11 is supplied by an input drive roll 14 and a cooperating pinch roll 15. A cooling platen 16, also described hereinafter, has a cooperating drive roll 17 to receive the print 11 from the heating platen 13 and quench the hot melt ink image thereon while moving the print away from the heating zone.

As illustrated in FIG. 1, the cooling platen 16 has two arrays of cooling fins 18 and 19 and the entire hot melt ink image treatment arrangement is enclosed in a housing 20. A spring device 21 supported by the interior surface of the housing 20 has a spring arm 22 which urges the surface 23 of the cooling platen 16 against the output drive roll 17, the cooling platen being pivotally supported by a shaft 24 near the end of an arm 25 adjacent to the pinch roll 15. The housing is arranged to permit circulation of air either by convection or by a fan (not shown) past the arrays of fins 18 and 19 to remove heat from the cooling platen and maintain the temperature of that platen within a desired range, such as below 55° C, to assure rapid cooling of the hot melt ink in the image on the substrate after it leaves the heating zone. Alternatively, if desired, the cooling platen may be cooled by liquid circulation or by a thermoelectric cooling device.

The heating platen 13 includes an electric heater 26 mounted at the rear surface of a platen body 27 and covered by a layer of insulation 28 which also fills the gap between the heating and cooling platens to inhibit direct heating of the adjacent portion of the cooling platen 16. Alternatively, if desired, an air gap may be provided between the adjacent ends of the heating and cooling platens. In order to provide improved quality hot melt ink images by spreading of hot melt ink drops deposited on a substrate 30 by an ink jet printer as described in the above-mentioned Fulton et al. U.S. Pat. No. 4,873,134 and Hoisington et al. U.S. Pat. No. 4,971,408, the substrate 30 should be heated in the heating zone to a controlled temperature above the melting point of the ink, such as, for example, 95° C., for a period of, for example, 0.5 to 10 sec. and, preferably, 1 to 5 sec., preferably by contact heat transfer.

A guide member 31, spaced from a substrate-engaging surface 32 of the heated platen body 27, is positioned to enclose the heating zone and to guide the leading and trailing edges of the substrate 30 as it is driven by the input rolls 14 and 15 through the heating zone and into the nip between the cooling platen 16 and the output drive roll 17. Accordingly, the temperature of the platen body 27 is maintained at a desired level above the melting point of the ink and the drive rolls 14 and 17 are arranged as described hereinafter to maintain each portion of the transparency 11 in the heating zone for the desired length of time.

Since the substrate is heated by heat transfer contact with a temperature-controlled platen, the temperature of the substrate will approach the temperature of the platen at a rate with a thermal time constant, i.e., the time in which the temperature difference is reduced by 63%, of approximately 0.05 sec. to 0.10 sec. As a result, if the platen temperature is sufficiently above the melting point of the ink, the desired substrate and ink temperatures can be achieved within the first 0.1 sec. to 0.4 sec., and thereafter it is only thermally necessary to prevent the substrate from cooling before leaving the heating zone.

Figure 2:
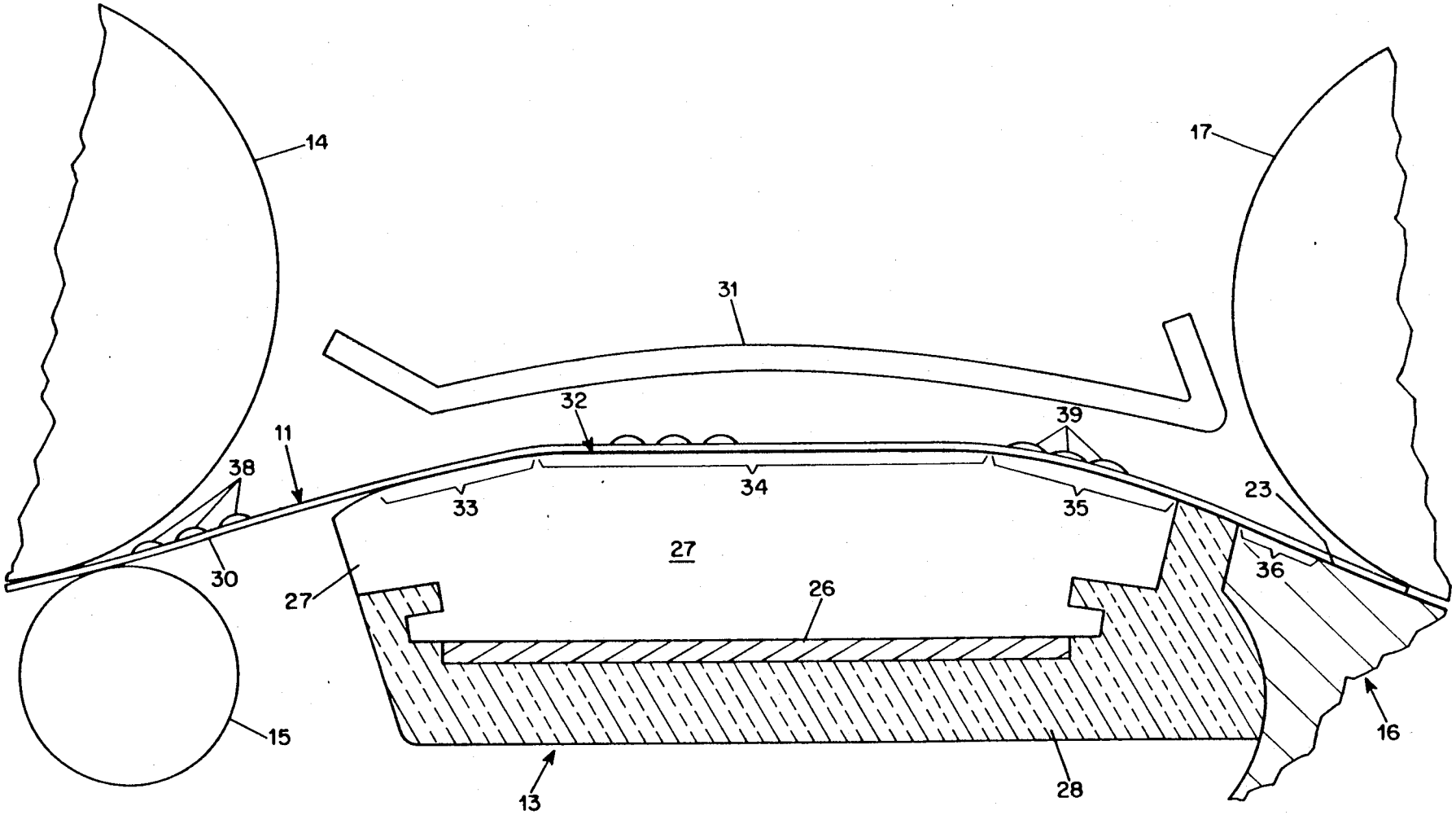
FIG. 2 is an enlarged fragmentary view of the arrangement shown in FIG. 1 illustrating the platen arrangement in greater detail.

As best seen in FIG. 2, the heated substrate-engaging surface 32 of the platen 27 has a curved surface section 33 at the input end, a substantially flat central section 34, and another curved section 35 at the output end of the heating zone. Cockle of the substrate not only detracts from the appearance of the print but, more importantly, causes portions of the substrate to be held out of contact with the heating and cooling platens. Where thermal contact heat transfer is required, as in the described platen arrangement, separation of the substrate from the platen surface by more than about 1 or 2 mils can increase the heat transfer time constant by a factor of two or more so that the desired heating and cooling rates may not be achieved.

The curved surfaces 33 and 35 are arranged to have a curvature which is sufficient to prevent cockle of the substrate 11 as it moves between room temperature at the input end and the high-temperature heating zone and between the heating zone and the low-temperature cooling platen. For example, these curved surfaces may have a radius of less than 8 cm. and preferably 3 cm. to 5 cm. The central section 34 of the heating platen is preferably flat but, if desired, it may be slightly curved, so long as the curvature imparted to a transparency substrate during its passage along the heating platen is not great enough to prevent it from being overcome by the subsequent decurling action of the cooling platen. Preferably, the radius of curvature of the central section 34 is at least 5 cm.

The optimum curvatures of the input and output surfaces 33 and 35, and of the center section 34, if curved, depend upon the ambient temperature, the processing temperature, which is related to the melting temperature of the ink, and the glass transition temperature of the substrate. Of course, if the glass transition temperature of the substrate is above the processing temperature, the curvatures will not cause the substrate to curl and, as long as the radius is small enough to prevent cockle, the values of the curvatures are not important. The radius of curvature required to prevent cockle is given by the equation:

$$R \leqq \frac{E \cdot t \cdot k}{\Delta T \cdot \alpha}$$

where E is Young's Modulus of the substrate material at the processing temperature, t is the thickness of the substrate, k is a constant, ΔT is the difference between the processing temperature and the lower of the inlet temperature and the quenching temperature, and o is the thermal expansion coefficient of the substrate material. Since Mylar has a high Young's Modulus and a low thermal expansion coefficient, it is a preferred material for use as a transparency substrate.

In addition, the angular length of each of the input and output curved surfaces, i.e., the portion 33 and the portion 35 together with the adjacent insulation and cooling platen surfaces, should be great enough to provide good mechanical stability of the curved substrate. For a 4 mil (0.1 mm) Mylar thick substrate, which is the size and type most readily available, and for most paper substrates, the angular length of those surfaces is preferably at least 10° and desirably 15°.

In order to transport the substrate 30 through the heating zone at a controlled rate, the output drive roll 17 is arranged to drive the substrate at a rate faster than it is driven by the input drive roll 14, and the input drive roll has a one-way clutch arranged to permit the substrate to turn it while causing sufficient drag to hold the substrate against the surface 32 of the platen 27. The slower speed of the input drive roll 14 is selected to permit the leading edge of the substrate 11 to be retained in the heating zone for a slightly longer period to compensate for any lack of close contact with the surface 32 before the substrate is engaged between the drive roll 17 and the surface 23 of the quench platen 16.

For example, the input drive roll 14 may be arranged to advance the substrate 11 at a rate of about 0.5 cm/sec, whereas the output drive roll 17 is arranged to drive the substrate at a rate of about 1 cm/sec. With a total length of the heated platen surface 32 of about 2.5 cm, this arrangement provides a residence time in the heating zone of about 5 sec. for the leading edge of the substrate which is not held tightly against the surface 32, since it has not been engaged by the output drive roll 17, and a residence time of about 2.5 sec. for the rest of the substrate 11, which, except for the trailing end, is held tightly against the heated surface 32 of the platen after the leading edge has been engaged by the output drive roll 17. Since the substrate has been substantially heated by the time the trailing end leaves the input drive roll 16, it is not necessary to hold that end in intimate contact with the platen surface. Preferably, the substrate drive speed provided by the drive roll 17 is in the range from about 0.25 to 5 cm/sec. and, desirably, the drive speed is in the range from 0.5 to 2 cm/sec.

In the illustrated embodiment, the angular length of the input curved surface section 33 may be about 10°, providing a linear curved surface length of about 0.6 cm, and the angular length of the output curved surface section 35 may be about 5°, providing a curved surface length of about 0.3 cm so that, at a drive speed of 1 cm/sec., the residence time of the portion of the substrate in contact with the output curved surface is only about 0.3 sec. On the other hand, the substrate is held close to or against the flat portion 34 of the platen for about 1.6 secs. As a result of the beam strength of the substrate material, the substrate will not necessarily be held in complete contact with the platen surface 32 along the entire length of the center section 34.

Because the polyester material of a substrate such as Mylar is thus held against the flat or substantially flat surface portion 34 during a large portion of its passage through the heating zone and for a time which is long enough to permit the substrate material to relax, it retains less of the curvature resulting from its passage along the curved surface portions of the platen surface 32.

The cooling platen 16 has a quenching zone 36 adjacent to the output end of the heating zone which receives the substrate 30 as it passes out of the heating zone and quenches the ink image thereon at a rapid rate to avoid crystallization and frosting. For this purpose, the cooling platen temperature in the quenching zone 36 should be low enough to cool the ink at a rate of at least 50° C./sec. and, preferably, at least 500° C./sec. Cooling by contact heat transfer to a metal or other heat-conductive surface is adequate for this purpose, as long as the quench surface is maintained adequately below the melting temperature of the ink. Preferably, the cooling platen temperature in the quenching zone is at least 10° C. below the melting point of the ink and, desirably, it is at least 30° C. below the melting point.

With a quenching zone temperature 30° C. below the ink melting point and a substrate moving at a rate of about 1 cm/sec., molten ink on the substrate will solidify in substantially less than one second and, preferably, less than one-half second, corresponding to a distance of less than 1 cm. so that a quenching zone 36 having a length of 1 cm. should be sufficient. Therefore, if the drive roll 17 engages the surface of the substrate 30 containing the ink drops at least 1 cm. beyond the beginning of the quenching zone, the ink will be solidified before the drive roll engages the surface, thereby preventing any flattening or other deformation of the ink drops which might degrade the projected image quality of the transparency. This also avoids any offsetting of soft ink onto the drive roll which could produce image defects in a subsequent portion of the same print or other prints.

Since there are compressive cockle-inducing stresses in the substrate until the substrate is cooled, it is important to continue the curvature at the output end of the heating zone into the quenching zone 36. For this purpose, the surface of the insulating layer 28 between the heating platen and the cooling platen and the surface 23 of the cooling platen in the quenching zone have the same curvature as that of the region 35 of the heating platen surface 32. This not only prevents cockle, but also assures good contact of the substrate with the surface 23 of the cooling platen in the quenching zone to provide good heat transfer so that any molten ink drops on the substrate are solidified before they reach the output drive roll. For example, if the quenching time is 150 milliseconds and the substrate is driven at 1 cm/sec., a quenching zone length of a few millimeters is sufficient.

After the substrate has passed the quenching zone 36 and is engaged by the output drive roll 17, it is held against and driven around a curved cooling platen surface 37 which has a reverse curvature with respect to the surface portions 33 and 35. Even though a transparency substrate has already been cooled below the glass transition point of the substrate material when it reaches the drive roll 17, it has been found surprisingly that the curl produced in the substrate by the curved surfaces of the heated platen can be reduced or eliminated by passing it along the reverse-curvature cooling platen surface 37 promptly after leaving the quenching zone. The radius of curvature of the reverse curved surface 36 should be less than that of the surfaces 33 and 35 and, desirably, the radius of curvature is less than half that of the surfaces 33 and 35. In a preferred arrangement, the radius of the surface 37 is about one-quarter of that of the surfaces 33 and 35, i.e., about one cm. The effect on decurling is surprising because the stress in a 4-mil Mylar substrate in the 1 cm. radius curvature section 36 is only about 2,500 psi, which is less than 25% of the yield strength of the material at a cooling platen temperature of about 45° C.

In a typical example, a print 11 having solid hot melt ink drops 38 which were deposited on the surface of the substrate 30 during ink jet printing is passed through a heating zone having a platen temperature of about 95° C. at a rate of 1 cm/sec. In the heating zone, the solid ink drops, which have a melting point of about 80° C., are melted and permitted to spread on the surface of the substrate to produce drops 39 having a larger area and an increased radius of curvature, resulting in improved image quality as described in the above-mentioned Fulton et al. and Hoisington et al. applications. In the drawings, the drops 38 and 39, which may, for example, be about 0.1-0.2 mm. in diameter, are illustrated in exaggerated size to show the change of surface shape which results from the processing.

As the substrate 11 passes from the heating zone, it moves into thermal contact with the surface 23 of the cooling platen 16 in the quenching zone 36 which, in this example, is maintained at about 45° C. With good thermal contact between the substrate and the surface 23 because of the curved surface in the quenching zone, the thermal transfer time constant is about 0.1 sec., causing the temperature of the substrate and its ink image to be reduced by about 32° C. (63% of the difference between 95° C. and 45° C.) to about 63° C. in about 0.1 sec. or about 1 mm. of substrate motion into the quenching zone. The average rate of cooling during this time period is 320° C./sec., but the initial cooling rate during the time in which the temperature is reduced to a level below the 80° C. melting point is higher since the cooling rate is a negative exponential. During the next 0.1 sec., the temperature falls to about 52° C. and the ink temperature continues to approach 45° C. as the substrate moves along the cooling platen.

Such rapid cooling prevents significant crystallization and frosting of the ink image and assures that the ink drops 39 are solidified before they are engaged by the drive roll 17. Thereafter, the substrate 11 is driven around the reverse-curvature surface 37 of the platen, which results in substantial elimination of any curvature caused by passage of the substrate 30 along the curved surfaces 33 and 35 while at an elevated temperature.

Although the invention has been described herein with reference to specific embodiments, many modifications and variations therein will readily occur to those skilled in the art. For example, the curved surfaces 33, 35, 36 and 37 are described herein with reference to curvatures of fixed radius. It will be apparent, however, that those surfaces may have a varying radius of curvature. Accordingly, all such variations and modifications are included within the intended scope of the invention.

We claim:

1. A method for providing a substrate with a coating of a hot melt ink having reduced light transmission losses caused by crystallization and frosting of the ink comprising maintaining the molten hot melt ink coating on the substrate for a selected time without cooling the substrate and thereafter cooling the ink coating at a rate of at least 50° C. per second to minimize said crystallization and frosting.

2. A method according to claim 1 wherein the ink coating is cooled at a rate of at least 100° C. per second.

3. A method according to claim 1 wherein the ink coating is cooled at a rate of about 500° C. to 1000° C. per second.

4. A method according to claim 1 wherein the molten ink coating is solidified after being applied to the substrate and the solidified ink coating is thereafter heated to a temperature above its melting point and then cooled at a rate of at least 50° C. per second.

5. A method according to claim 4 wherein the ink coating is cooled at a rate of at least 100° C. per second.

6. A method according to claim 4 wherein the ink coating is cooled at a rate of about 500° C. to 1000° C. per second.

* * * * *